US005582251A

United States Patent [19]

Bailey et al.

[11] Patent Number: 5,582,251

[45] Date of Patent: Dec. 10, 1996

[54] DOWNHOLE MIXER

[75] Inventors: J. Robert Bailey, Missouri City; Rustom K. Mody, Houston; Richard G. Van Buskirk, Waller, all of Tex.

[73] Assignees: Baker Hughes Incorporated; Exxon Production Research Company, both of Houston, Tex.

[21] Appl. No.: 424,158

[22] Filed: Apr. 17, 1995

[51] Int. Cl.[6] ..... E21B 33/132; E21B 33/138

[52] U.S. Cl. ..... 166/286; 166/162; 166/317; 166/385

[58] Field of Search ..... 166/286, 295, 166/294, 285, 300, 297, 298, 385, 162, 169, 168, 65.1, 317

[56] References Cited

U.S. PATENT DOCUMENTS

| | | | |
|---|---|---|---|
| 3,153,449 | 10/1964 | Lebourg | 166/286 |
| 3,347,315 | 10/1967 | Lanmon, II | 166/286 |
| 3,348,621 | 10/1967 | Schuster | 166/286 X |
| 3,692,106 | 9/1972 | Basham et al. | 166/169 X |
| 3,709,296 | 1/1973 | Glenn, Jr. | 166/295 X |
| 4,064,941 | 12/1977 | Smith | 166/162 X |

OTHER PUBLICATIONS

Alumax Extrusions Inc., advertisement, date unknown, 1 page.

Cartridge Solenoid Valves, GS02–33, 2/3 way side cylinder port spool valve, catalog page, date unknown, 1 page.

Sterling Hydraulics, GS02, catalog page, May 1992, 1 page.

Beswick Engineering Co., Inc., Quick Disconnects, Miniature Multiple Line Quick Disconnects–Snap Type, date unknown, 1 page.

Artisian Precision Timing Devices, catalog page, date unkown, 1 page.

*Primary Examiner*—Stephen J. Novosad

*Attorney, Agent, or Firm*—Rosenblatt & Redano, P.C.

[57] ABSTRACT

The invention discloses an apparatus for storing one or more constituents in a downhole tool. The constituents are segregated from each other until such time as the tool is actuated. At that time, the constituents are forced from their storage position and mixed as they are pushed from their storage position. The resultant mix is then directed to the location where the mixture will finally be placed for eventual solidification. The apparatus and method are useful for inflation of bridge plugs or external casing packers, as well as other downhole applications. Significant time is provided for the surface operator prior to initiation of the constituent elements by segregating the ingredients until shortly before they are mixed and directed to their final destination. Should a problem arise prior to mixing, the unmixed ingredients can be withdrawn from the wellbore.

24 Claims, 3 Drawing Sheets

DOWNHOLE MIXER

FIELD OF THE INVENTION

The field of this invention relates to mixing techniques and an apparatus for combining materials downhole.

BACKGROUND OF THE INVENTION

In the past, various materials have been used in cementing downhole. Cementing has involved not only the filling of or around casings downhole, but also inflatable plugs or external casing packers which are inflated with a cement material and are designed to be in place permanently. If the various materials making up the cement slurry are premixed at the surface and then spotted where needed downhole, sufficient time to properly spot the mixture may not be available before the slurry begins to solidify. This presents problems for the operator if any problems are encountered during run-in with the constituent components already premixed. If the slurry hardens before the job can be done, then time and money will be lost. For example, the inflating and setting medium for an inflatable bridge plug, if premixed at the surface, has a typical working time of 2–8 hours before it begins to harden to the point of unpumpability. Many other downhole applications, using materials which are initially pumpable and by design later solidify in locations desired by the operator, also create this time concern.

These time concerns of spotting the hardening material in the position necessary prior to its reaching a condition where it is difficult to move or pump are alleviated by the apparatus and method of the present invention. The apparatus and method allow for storage and separation of constituent components while positioning the apparatus adjacent the area where such materials are to be used. The apparatus and method then provide for mixing of the constituent components downhole. The mixing is not initiated until the constituent ingredients are properly located downhole and all systems are found to be in good working order. The apparatus and method contemplate the mixing of the ingredients and the directing of such ingredients to the particular location where the combination can solidify as desired.

SUMMARY OF THE INVENTION

The invention discloses an apparatus for storing one or more constituents in a downhole tool. The constituents are segregated from each other until such time as the tool is actuated. At that time, the constituents are forced from their storage position and mixed as they are pushed through an isostatic mixing tube to the inflatable tool. The resultant mix is then directed to the location where the mixture will finally be placed for eventual solidification. The apparatus and method are useful for inflation of bridge plugs or external casing packers, as well as other downhole applications. Significant process control is given to the surface operator prior to initiation of reaction of the constituent elements by holding separate the ingredients until shortly before they are mixed and directed to their final destination. Should a problem arise prior to mixing, the unmixed ingredients can be withdrawn from the wellbore without complication.

DETAILED DESCRIPTION OF THE PREFERRED EMBODIMENT

Figure 1A:
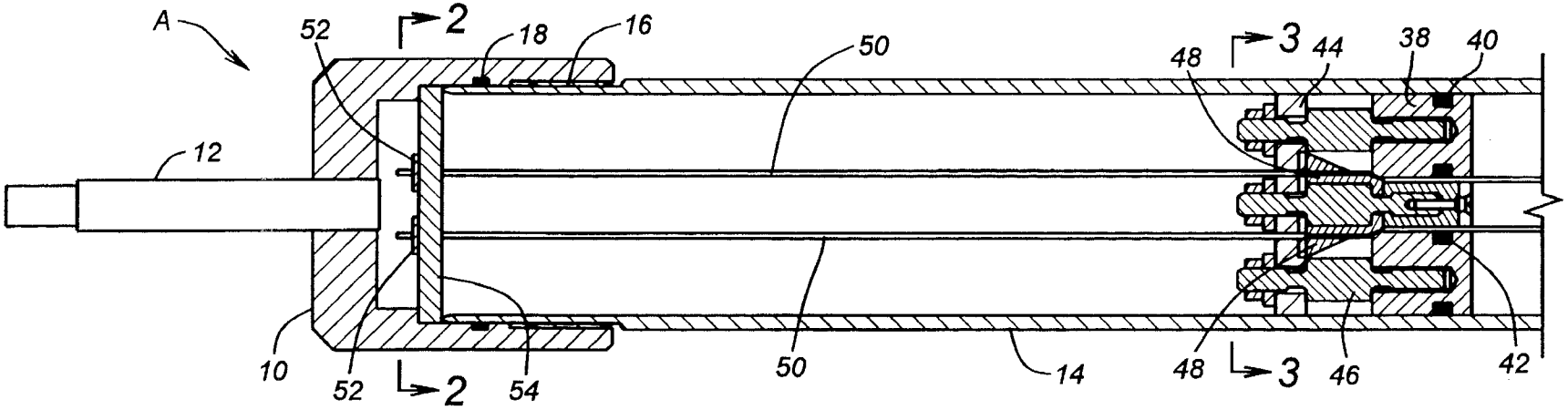
FIGS. 1*a–b* are sectional elevational views of the apparatus.
Figure 1B:
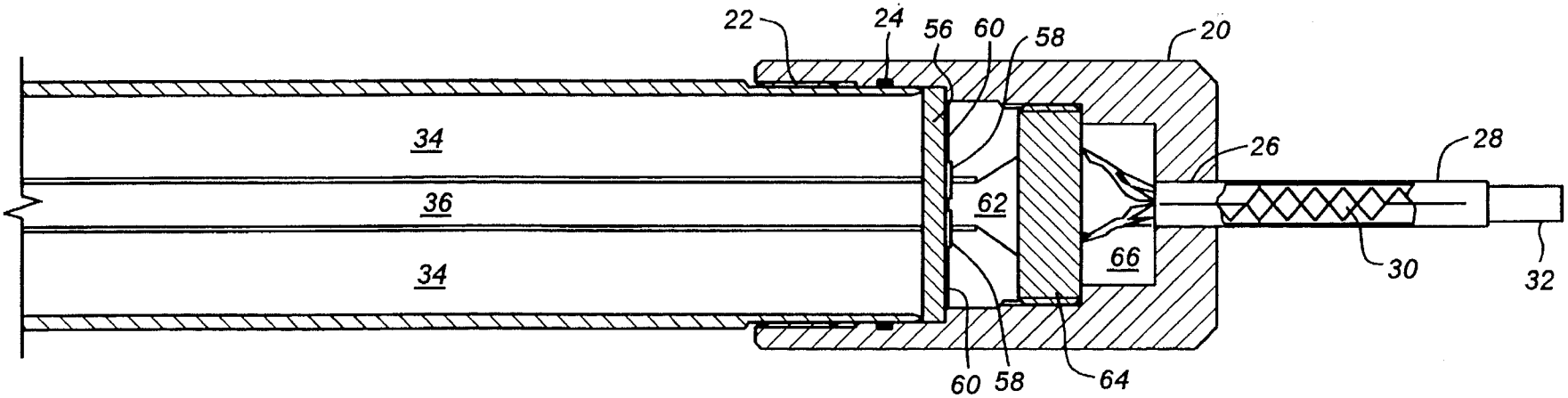
Figure 3:
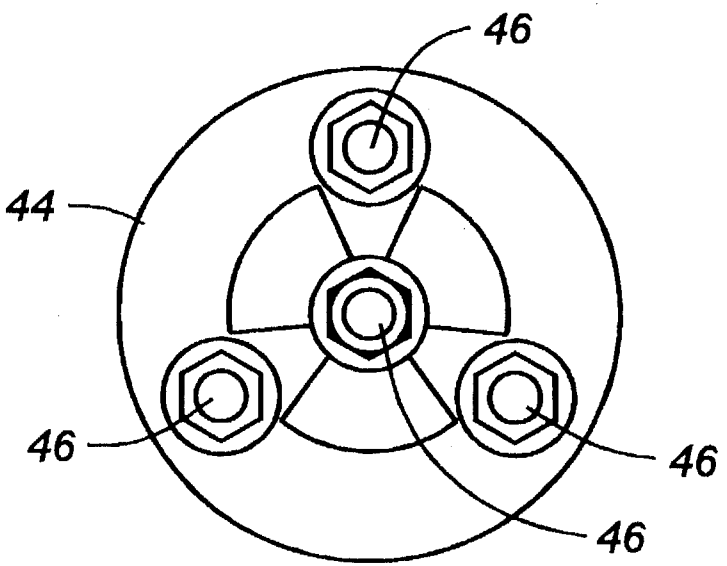
FIG. 3 is a section view along lines 3—3 of FIG. 1*a*.

The apparatus A is shown in FIGS. 1*a* and 1*b*. A top sub 10 has an inlet pipe 12 connected thereto. Top sub 10 is connected to body 14 at thread 16. Seal 18 seals the connection between top sub 10 and body 14. Body 14 is connected to bottom sub 20 at thread 22. Seal 24 seals the threaded connection adjacent to thread 22. Bottom sub 20 has an outlet 26 which is connected to an outlet tube 28. A known in-line mixer 30 is integral to and within tube 28. The mixed chemicals, schematically represented as 32, exit the outlet tube 28 and are directed to that portion in the well where they will be allowed to set up, such as a bridge plug, an external casing packer, or another downhole application.

The apparatus A, as shown in FIGS. 1*a* and 1*b*, is configured for mixing of two elements but can be configured for mixing any number of elements without departing from the spirit of the invention. The first element is preferably placed at the surface into annular chamber 34, while the second is similarly placed in tube 36. A piston 38 is sealed against body 14 by seal 40 and against tube 36 by seal 42. Piston 38 is essentially in pressure balance despite the depth of the apparatus A in the wellbore. Tube 36 is circumscribed by annular chamber 34 in the preferred embodiment, but other configurations of material storage involving discrete compartments may be used without departing from the spirit of the invention.

Figure 2:
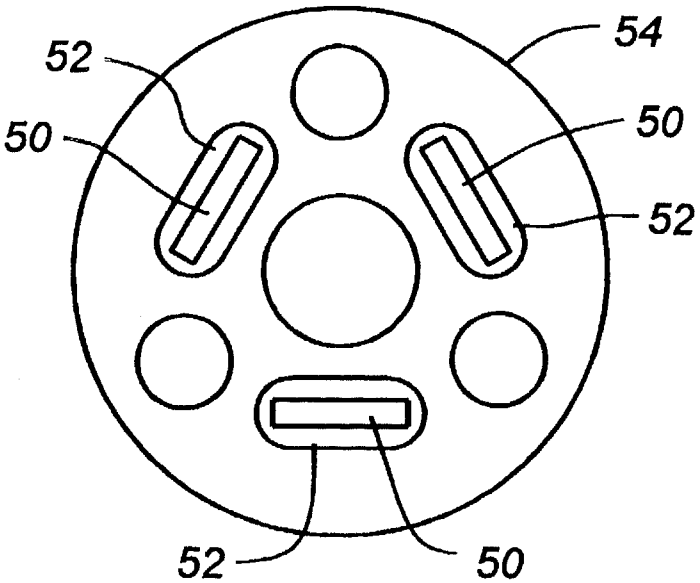
FIG. 2 is a section view along lines 2—2 of FIG. 1*a*.

Support plate 44 is connected to piston 38 by a series of studs 46. In the gap between support plate 44 and piston 38 are splitter blade or blades 48. In the preferred embodiment, the blades are inclined with respect to the axis of tube 36. Above piston 38 tube 36 is fragmented into segments 50. As shown in FIG. 2, in the preferred embodiment there are three segments 50 at 120° spacing. Each segment 50 is retained by a retainer 52 after it extends through end plate 54 (see FIG. 1), and plate 54 is retained between top sub 10 and body 14. Accordingly, the tube segments 50 are under tension between end plate 54 and piston 38. The lower end of tube 36 extends through bottom plate 56 and is retained by retainers 58. Bottom plate 56 can have temporary seals 60 to retain the constituent within tube 36 or annular chamber 34 until such time as they are ready to be mixed. Seals 60 can be rupture discs of a known type which can be prescored to break cleanly on increasing differential pressure. Below bottom plate 56 is a mixing chamber 62, followed by a mixing plate 64. Mixing plate 64 can be a plate with randomly located holes through which the material can flow. After the mixing plate is another mixing zone 66, ultimately leading to the outlet 26.

The components of the apparatus A now having been described, its operation will be reviewed. The apparatus A is fully assembled in the position shown in FIG. 1 by the initial addition of the compound or compounds to be mixed downhole. In a typical application, the annular space 34 may contain a cementitious material while the tube 36 may contain an expanding agent, such that upon mixing of the components from annular space 34 and tube 36, the mixture will initiate expansion of the mixed medium. This can be particularly useful when using the mixture to inflate and permanently set a packer or bridge plug. The expanding capability of the ingredients stored in tube 36 assists in maintaining the bridge plug or packer in the inflated condition as the material of the mixture sets up. The apparatus and method can be used to mix any materials, and the specific selection of materials is independent of the described invention.

Typically, the apparatus A is used in conjunction with a downhole pressure source, such as a motor and a fluid pump (not shown), whose output is connected to inlet pipe 12. Ultimately, pressure builds on piston 38. The studs 46 keep the support plate 44 at a fixed distance from the piston 38. As previously stated, the support plate 44 also supports the blade or blades 48. As the pressure arises above piston 38, it will begin to move. Movement of piston 38 will result in a longitudinal cut or cuts in tube 36 as piston 38 progresses. These longitudinal cuts facilitate the downward movement of plate 44 whose initial movement begins on segments 50. Accordingly, in order to avoid getting plate 44 into a bind, advancement of the piston 38 slices through tube 36, which may itself be prescored to assist in the cutting operation of the blades 48. To the extent there are temporary seals 60 employed adjacent the bottom plate 56, downward movement of the piston 44 builds up pressure in annular space 34 and tube 36. In response to the pressure build-up, the temporary seals 60 are broken and the material that is stored in annular space 34 and tube 36 is pushed outwardly through bottom plate 56 and mixing plate 64. Mixing plate 64 can be a plate with a plurality of openings, all of which promote mixing of the constituents as they are pushed out from annular space 34 and tube 36. Those skilled in the art can appreciate that a multiplicity of tubes can be deployed in the body 14 without departing from the spirit of the invention. The operation with a multiplicity of tubes would be similar to that shown in the apparatus A of FIGS. 1*a* & 1*b*, except that a greater number of elements could be mixed. The mixing plate 64 then further encourages mixing in the mix zone 66 before the mixture enters outlet 26. Thereafter, an in-line static mixer 30 can be employed of a type well-known in the art to further ensure thorough mixing prior to conducting the mixture of chemicals 32 to the bridge plug, or external casing packer, or other zone in the wellbore for deposition and hardening.

Those skilled in the art will appreciate that the stroke of piston 38 displaces at a fixed volumetric ratio as between the tube 36 and the annular space 34. While two unique areas for two discrete components have been described in FIGS. 1*a* and 1*b*, the apparatus A can be used to store a single constituent and then be further used to pump that constituent out of the body 14 by displacing piston 38 to introduce a single constituent into a bridge plug, packer, or other downhole use.

In one particular application of the apparatus A, the annular space 34 can contain a cement while the tube 36 contains a hardening/expanding additive and/or a liquid gas generator. The cementitious material in annular space 34 does not normally set up until several hours have elapsed. However, when mixed with the material in tube 36, the cure time is reduced to only a few hours. However, since the mixing occurs downhole adjacent the point of use, a few hours is more than enough to adequately pump the mixture to the place of its final destination. On the other hand, if difficulties develop prior to the initiation of the mixing of the components, all the components can be withdrawn from the wellbore until such operational difficulties are repaired. Once the repairs are made, the same constituents (or newly prepared constituents) can be rerun into the wellbore and used as intended by employing the downhole mixing apparatus. Accordingly, the apparatus A adds flexibility in performing workover operations, such as installing inflatable packers for permanent zonal isolation, or using such chemicals downhole as part of a remedial and stimulation program, or for maintenance or other tasks downhole. The apparatus A can be used with one or more pumps connected to one or more inlets 12. Each constituent can be separately defined in a tube or an annular space and actuated by a pump or pumps (not shown). Electronic sensors can be employed with the apparatus A to communicate the position of piston 38 and transmit information to the surface in a manner well known in the art.

Figure 4A:
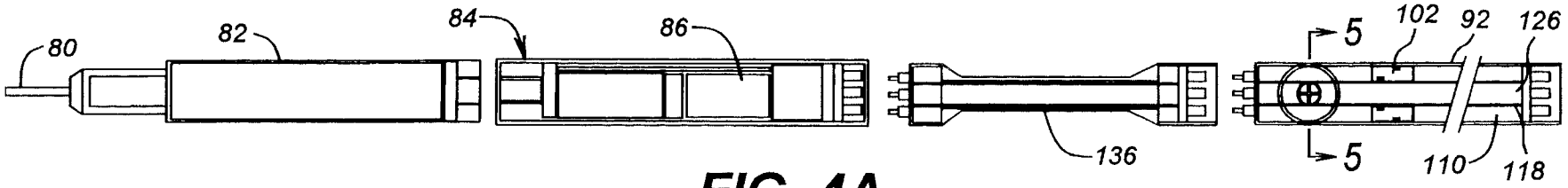
FIGS. 4*a–c* are sectional elevational views of an alternative embodiment suitable for wireline applications for downhole mixing.
Figure 4B:
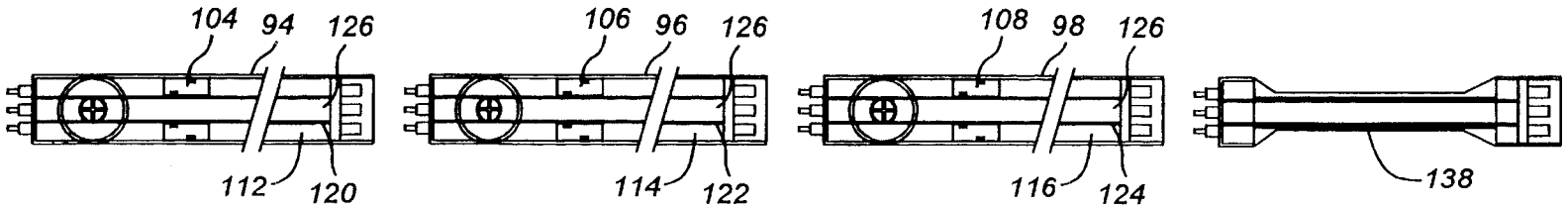
Figure 4C:
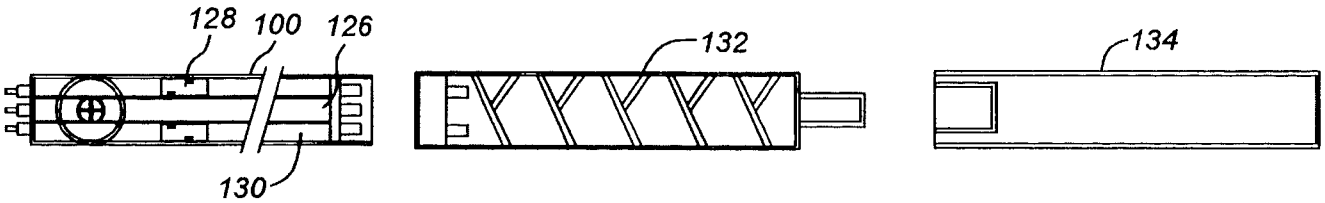

FIGS. 4*a–c* and 5 illustrate an alternative embodiment of the apparatus and method of the present invention particularly suited for wireline applications. Those skilled in the art will appreciate that typical wireline applications involve a lubricator of a fixed length, usually approximately 40 feet, through which the tools must be lowered. The apparatus of the present invention, as illustrated in FIGS. 4*a–c*, accommodates a way of inserting through a lubricator a tool that may actually have to exceed the overall length of the lubricator.

Figure 5:
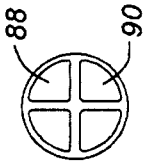
FIG. 5 is a section along lines 5—5 of FIG. 4*a*.

As shown in FIG. 4*a*, the wireline 80 supports a downhole pump 82, the output of which is controlled through a control module 84. The control module includes one or more solenoid valves 86 which can direct the output of pump 82 selectively into flow channels 88 or 90, as shown in FIG. 5. In the assembly shown in FIGS. 4*a–c*, a plurality of ingredient modules are illustrated. A series of modules 92–98 are illustrated to house the more plentiful ingredient. Accordingly, more of those modules exist than for the second ingredient represented by module 100. In FIGS. 4*a–c*, module 100 is connected to flow channel 90 while modules 92–98 are all aligned to flow channel 88. The pump 82, in combination with the solenoid valves 86 and control module 84, which includes logic circuits, microprocessors and timers, can direct flow into flow channel 88 or 90 on a time basis. By directing the output of pump 82 into flow channel 88, the volumetric displacement of pump 82 is applied to pistons 102, 104, 106, and 108, causing all these pistons for the initial component to move in tandem. Below each piston 102–108 is a storage location to house the initial ingredient. The storage locations are indicated as 110–116. Each of these storage locations 110–116 has, respectively, an outlet 118–124 which is initially sealed from the outlet path 126 which extends through all the components. In a similar manner, module 100 contains the other ingredient to be mixed and has in it a piston 128 over a storage compartment 130, which ultimately opens into the mixing path 127 upon movement of the piston 128. The pump 82 can selectively drive piston 128 through flow channel 90 for a particular predetermined time and then alternate to driving the other pistons 102–108 through flow channel 88 for a different time. Since the pump used is preferably of a fixed volumetric delivery per unit time, accurate mixing can be accomplished by judicious control of the solenoid(s) 86 so that what is delivered to mixer 132 is the precise mix desired, whereupon the mixture exits the mixer 132 and goes directly into the downhole tool 134.

Optionally, deployment bars such as 136 and 138 can be used to facilitate the introduction of the apparatus illustrated in FIG. 4 through a lubricator which may be shorter than the combined length of the apparatus. The deployment bars allow isolation of the well when wellhead rams seal around the bars to facilitate their introduction through a lubricator which does not exceed the overall length of the apparatus in a manner that is commonly known in the art. The development bars 136 and 138 merely carry through them the passages from the solenoid(s) 86 to provide flow continuity internally between the assembled modules. Those skilled in the art will appreciate that different numbers of modules can be deployed without departing from the spirit of the invention. One, two, or more ingredients can be mixed as desired with the proper sequencing and control of the solenoid(s). The apparatus is ideally suited for wireline applications, which allows the materials to be mixed to be positioned adjacent the downhole tool 134 in a rapid manner.

The foregoing disclosure and description of the invention are illustrative and explanatory thereof, and various changes in the size, shape and materials, as well as in the details of the illustrated construction, may be made without departing from the spirit of the invention.

What is claimed is:

1. A method of mixing at least a first and second material downhole, comprising the steps of:

loading said first material in a first compartment in a tool body;

loading said second material in a second compartment in a tool body initially isolated from said first compartment;

lowering the tool into a wellbore; and initiating mixing of said first and second materials within said tool body prior to application of said mixed fluids downhole.

2. The method of claim 1, further comprising the steps of:

applying pressure to said first and second compartments; and displacing said first and second chemicals from said first and second compartments in a predetermined volume relation to each other.

3. The method of claim 2, further comprising the step of:

using a common piston to apply pressure to said first and second comparments.

4. The method of claim 1, further comprising the steps of:

mounting the tool on a wireline; and using a downhole pump to initiate said mixing.

5. The method of claim 4, further comprising the steps of:

using sequencing valves to direct output of said pump;

using a constant volume delivery pump; and controlling by volume the mixture between said first and second materials by time control of said sequence valves.

6. The method of claim 4, further comprising the steps of:

using a static mixer to mix the first and second materials after they are displaced from said first and second compartments; and directing the mixed materials from the static mixer into a downhole tool.

7. The method of claim 6, further comprising the steps of:

using a gas-generating material as one of the materials to be mixed;

adding the mixed materials from said static mixer to a packer; and using the gas-generating material to hold packer inflation as the mixed materials in the packer harden.

8. A injection apparatus for delivering at least one material to a desired position downhole, comprising:

a body defining at least two compartment therein;

at least one piston in said body movably mounted therein to reduce the volume of said compartments and drive out of said compartments materials initially stored therein; and means for selectively actuating said piston when said body is positioned downhole to mix the materials in said body prior to driving the mixed materials from said body.

9. The apparatus of claim 8, further comprising:

said piston, upon actuation, driving said materials from each compartment in a predetermined volume ratio.

10. The apparatus of claim 9, wherein:

said piston reduces the stored volume of said compartments in tandem.

11. A method of mixing at least a first and second material downhole, comprising the steps of:

loading said first material in a first compartment in a tool body;

loading said second material in a second compartment in a tool body initially isolated from said first compartment;

nesting one of said first and second compartments within the other;

lowering the tool into a wellbore; and initiating mixing of said first and second materials downhole.

12. A method of mixing at least a first and second material downhole, comprising the steps of:

loading said first material in a first compartment in a tool body;

loading said second material in a second compartment in a tool body initially isolated from said first compartment;

nesting one of said first and second compartments within the other, and lowering the tool into a wellbore;

using a common piston to apply pressure to said first and second compartments;

applying pressure to said first and second compartments;

displacing said first and second chemicals from said first and second compartments in a predetermined volume relation to each other; and initiating mixing of said first and second materials downhole.

13. The method of claim 12, further comprising the step of:

providing at least one tube as said first compartment with an annulus around said tube as said second compartment.

14. The method of claim 13, further comprising the steps of:

extending said tube longitudinally through said piston; and continuing said tube in longitudinal segments beyond said piston.

15. The method of claim 14, further comprising the steps of:

providing at least one cutter on said piston; and longitudinally cutting said tube with said cutter to facilitate piston advancement.

16. The method of claim 15, further comprising the step of:

maintaining said tube in tension while said piston is advancing.

17. The method of claim 15, further comprising the step of:

supporting said cutter on a support plate connected to and spaced apart from said piston.

18. The method of claim 16, further comprising the step of:

creating flow communication within the body of the tool between said tube and said annulus as a result of piston movement.

19. The method of claim 18, further comprising the step of:

providing a mixing plate in said tool body to allow said chemicals to mix as a result of passing therethrough.

20. The method of claim 19, further comprising the step of:

providing an in-line mixer at the outlet of said tool body.

21. The method of claim 20, further comprising the step of:

moving said piston with fluid pressure.

22. A injection apparatus for delivering at least one material to a desired position downhole, comprising:

a body defining at least two compartments selectively isolated from each other;

said compartments are nested one within the other, with said first compartment comprising a tube and said second compartment comprising the surrounding annulus;

a piston in said body movably mounted therein to reduce the volume of said compartments and drive out of said compartments a materials initially stored therein;

said tube extends through said piston and is retained in tension in said body;

said piston reduces the stored volume of said compartments in tandem;

means for selectively actuating said piston when said body is positioned downhole;

whereupon actuation of said piston, material is delivered from each compartment in a predetermined volume ratio.

23. The apparatus of claim 22, wherein:

said tube extends in longitudinal segments beyond said piston;

said piston further comprising at least one cutter; and said cutter cutting said tube longitudinally in response to piston progress.

24. A injection apparatus for delivering at least one material to a desired position downhole, comprising:

a body defining at least two compartments selectively isolated from each other;

a piston in said body movably mounted therein to reduce the volume of said compartments and drive out of said compartments a materials initially stored therein;

said piston reduces the stored volume of said compartments in tandem;

means for selectively actuating said piston when said body is positioned downhole;

said body further comprises a mixing plate therein to facilitate mixing;

said compartments initially isolated from each other by a breakable member on each compartment which breaks as a result of piston movement reducing the volume of said compartments;

said mixing plate further promoting mixing in said body as the material from each compartment passes therethrough; and whereupon actuation of said piston, material is delivered from each compartment in a predetermined volume ratio.

* * * * *